US010287141B2

(12) United States Patent
Orlean et al.

(10) Patent No.: US 10,287,141 B2
(45) Date of Patent: May 14, 2019

(54) LATTICE PIECE ELEMENT AND LATTICE PIECE FOR CRANE BOOM

(71) Applicant: Liebherr-Werk Ehingen GmbH, Ehingen/Donau (DE)

(72) Inventors: Andreas Orlean, Lenningen (DE); Uwe Frommelt, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 15/427,352

(22) Filed: Feb. 8, 2017

(65) Prior Publication Data

US 2017/0275143 A1 Sep. 28, 2017

(30) Foreign Application Priority Data

Feb. 10, 2016 (DE) ..... 10 2016 001 558
Jan. 20, 2017 (DE) ..... 10 2017 000 525

(51) Int. Cl.

*B66C 23/68* (2006.01)
*B66C 23/70* (2006.01)
*B66C 23/06* (2006.01)
*B66C 23/64* (2006.01)

(52) U.S. Cl.

CPC ..... *B66C 23/68* (2013.01); *B66C 23/70* (2013.01); *B66C 23/06* (2013.01); *B66C 23/64* (2013.01)

(58) Field of Classification Search

CPC ..... B66C 23/06; B66C 23/62; B66C 23/64; B66C 23/68; B66C 23/70
USPC ..... 52/654.1, 693, 845
See application file for complete search history.

(56) References Cited

U.S. PATENT DOCUMENTS 4,253,579 A * 3/1981 Williams ..... B66C 23/70 52/650.2
5,082,128 A * 1/1992 Franzen ..... B66C 23/70 212/177
5,487,479 A 1/1996 Pech et al.
2008/0173605 A1* 7/2008 Willim ..... B66C 23/68 212/177

(Continued)

FOREIGN PATENT DOCUMENTS

DE 19 37 030 U 4/1966
DE 10 2012 221 031 A1 5/2014

(Continued)

*Primary Examiner* — Michael R Mansen
*Assistant Examiner* — Juan J Campos, Jr.
(74) *Attorney, Agent, or Firm* — Dilworth & Barrese, LLP

(57) ABSTRACT

The present invention relates to a lattice piece for a crane boom consisting of a first and a second lattice section element, each comprising a first chord member which extends substantially parallel to the longitudinal direction of the lattice section element, a second chord member which extends substantially parallel to the longitudinal direction of the lattice section element, a first web member which is firmly connected with the first chord member and the second chord member, and preferably extends in the plane defined by the first chord member and the second chord member, wherein a first web member is firmly connected with the first chord member and rises from a plane defined by the first chord member and the second chord member, wherein at its end facing away from the first chord member the second web member includes a fastening means for a releasable connection.

21 Claims, 9 Drawing Sheets

(56) References Cited

U.S. PATENT DOCUMENTS

| | | | | |
|---|---|---|---|---|
| 2015/0314995 | A1* | 11/2015 | Schnittker | B66C 23/28 212/347 |
| 2016/0016765 | A1* | 1/2016 | Bohnacker | B66C 23/64 52/650.1 |
| 2016/0264384 | A1* | 9/2016 | Roodenburg | B66C 23/365 |

FOREIGN PATENT DOCUMENTS

| | | | | |
|---|---|---|---|---|
| EP | 2 759 661 | A1 | 7/2014 | |
| WO | WO-2015069096 | A1 * | 5/2015 | B66C 23/365 |

* cited by examiner

LATTICE PIECE ELEMENT AND LATTICE PIECE FOR CRANE BOOM

BACKGROUND OF THE INVENTION

This invention relates to a lattice piece for a crane boom and a lattice piece element. This is a novel lattice piece for a crane boom, which can be used to produce a crane boom in at least two different modifications. It is conceivable that such crane boom in essence only consists of a plurality of the lattice piece elements according to the invention or however only partly is constructed of lattice piece elements according to the invention and for the rest of other types of elements.

A crane boom of a mobile crane for example is a lattice boom which comprises a plurality of lattice pieces. The lattice boom of a mobile crane typically is erected only after transport to the site of use. Theoretically, there can even be realized a fly jib in lattice construction or a derrick boom with lattice pieces according to the invention. The fly jib can be of luffable, foldable or fixed design.

The dimensions of the crane boom in general are determined with reference to the required load capacity. In a succeeding step the transportability of the desired boom must be taken into account. In Germany, the maximum admissible length, height and width is regulated by the road traffic regulations (German StVO). It therefore is common practice to disassemble a lattice boom into many individual lattice pieces for road transport and thus reduce it in its length.

When the load capacity is to be increased further, lattice pieces of larger cross-sections are required, which renders road transport even more difficult.

A conventional lattice piece is known from DE 20 2008 004 663 U1, but here an increased material expenditure is required.

DE 10 2013 205 173 A1 describes a lattice piece whose assembly requires an increased expenditure.

SUMMARY OF THE INVENTION

It therefore is the objective of the present invention to provide a crane boom and its components which have regular road transport dimensions and thus can also be used under confined space conditions. It furthermore is advantageous when the boom involves little assembly effort, but if necessary can also have an increased load capacity. It would also be desirable when sections of the crane boom could be stored in a space-saving way for transport and storage.

This object is solved by means of a lattice piece which has the features herein. By this invention, broadening of a crane boom becomes possible to increase the lifting capacities, if necessary, wherein the claimed lattice piece consisting of lattice piece elements can variably be used when erecting a crane boom, is easy to transport, assembly-friendly and less expensive as compared to the alternatives known in the prior art.

The inventive lattice piece for a crane boom each consists of a first and a second lattice piece element. The respective lattice piece element each comprises a first chord member which substantially extends parallel to the longitudinal direction of the lattice piece element, a second chord member which substantially extends parallel to the longitudinal direction of the lattice piece element, a first web member which is firmly connected with the first chord member and the second chord member and preferably extends in the plane defined by the first chord member and the second chord member. The lattice piece element is characterized by a second web member which is firmly connected with the first chord member and rises from a plane defined by the first chord member and the second chord member, wherein at its end facing away from the first chord member the second web member includes a fastening means for a releasable connection.

A chord member typically describes the struts extending in longitudinal direction of a crane boom, which in the case of a crane boom rectangular in cross-section correspond to the corners of this cross-section. A web member on the other hand describes a rod-shaped element extending between two different chord members, which in a completely assembled crane boom with one of its ends is attached to a first chord member and with the other end is attached to a second chord member. When looking at a rectangular cross-section of a crane boom, the web members correspond to the connections between the corners of the rectangle. However, it is clear to the skilled person that the web members need not necessarily be oriented vertically to the longitudinal direction of a crane boom.

Due to the fact that the second web member, which rises from the plane defined by the first chord member and the second chord member, preferably is vertical to this plane, an approximately L-shaped section element is obtained, which can be used in two different embodiments of a crane boom. For this purpose the second web member has a fastening means for a releasable connection at its end facing away from the first chord member. It hence is possible that the preferably L-shaped section element can be joined to form a lattice piece rectangular in cross-section, which is divisible lengthwise. The division is made along the fastening means of the second web member. It is clear to the skilled person that a plurality of second web members of course can exist, which at an end facing away from their first chord member include or can include a fastening means.

From the two lattice piece elements identical in their basic construction a crane boom can be formed, which can be used both in a "narrow" variant and in a "broadened" variant.

For this purpose, the first lattice piece element preferably L-shaped in cross-section is arranged relative to the second lattice piece element such that the respective fastening means of the second web member rest against the second chord member of the other lattice piece element. When the fastening means of the second web member provides for creating a rigid, but releasable connection with the other, second chord member, the two preferably L-shaped lattice piece elements can be joined such that a lattice piece with substantially rectangular cross-section is obtained.

However, it also is possible that the two preferably L-shaped lattice piece elements are joined to form a U-shaped structure by rotating one of the two lattice piece elements by 180°. The fastening means of the second web members of the two lattice piece elements hence are connected with each other, so that an open side is obtained, which can be closed with an additional element. It is irrelevant for the basic idea underlying the invention how the open side of the U-shaped structure is oriented. Both an orientation of the open side down to the bottom or up to the top is conceivable. By the described reconstruction a new lattice piece can be produced, which has a much larger width than the initial section, in which the two preferably L-shaped lattice piece elements engage the second chord member with the fastening means of the second web member.

It is of course advantageous when the lattice piece consisting of two lattice piece elements in the non-broadened condition (=fastening means of the second web member of a first lattice piece element engage the second chord member of a second lattice piece element, and vice versa) has the same system dimensions as the remaining lattice pieces in the boom. The crane boom then can also be erected and operated with non-broadened lattice pieces. When the boom is constructed of broadened lattice pieces (=the fastening means of a second web member of a first lattice piece element engage the fastening means of a second web member of a second lattice piece element), the connection between broadened sections and other lattice pieces is effected via corresponding connecting pieces.

According to another advantageous modification of the present invention the second chord member of a lattice piece element includes a fastening means for a releasable connection. It then is possible that the second chord member includes several fastening means which are distributed along the longitudinal direction of the second chord member. The fastening means of the second chord member on the one hand are designed to cooperate with the fastening means of the second web member and on the other hand with a grating element which in a broadened condition of a crane boom formed by means of two lattice piece elements closes the open side.

Preferably, the fastening means arranged on the second web member is designed to cooperate with a fastening means arranged on the second chord member and/or with a second chord member itself. Furthermore it is advantageous when the fastening means arranged on the second web member also is designed to cooperate with a fastening means which corresponds to the fastening means arranged on the second web member. It then is possible to attach the fastening means on the second web member with another fastening means to another second web member or to produce an attachment with a second chord member.

According to another modification of the invention the arrangement positions of the at least one fastening means of the second chord member and of the at least one fastening means of the web member based on the longitudinal direction of the lattice piece element are identical. It thereby is ensured that when providing a further lattice piece element the connectability of the two lattice piece elements to one lattice piece is ensured.

Preferably, the second chord member includes several fastening means for a releasable connection, which in longitudinal direction of the second chord member are arranged symmetrically and/or equidistantly to each other.

According to a development of the invention the fastening means at the second chord member or the web member is designed to produce a releasable attachment by means of a bolt connection. Preferably, the fastening means is a fork or finger of a fork-finger connection or a fork of an asymmetrical fork-fork connection.

Preferably, the fastening means is designed to accommodate a bolt in longitudinal direction of the lattice piece element or to accommodate a bolt in a direction extending transversely to the longitudinal direction of the lattice piece element, which can be parallel to the plane formed by the first chord member and the second chord member.

When the bolts are arranged in longitudinal direction of the lattice piece element, the construction of a lattice piece of two lattice piece elements or a reconstruction from the non-broadened to the broadened lattice piece design is simplified, as the lattice piece elements and further additional outcrossing elements can be put into each other more easily.

In the case of a bolt arrangement which is vertical to the longitudinal direction and preferably parallel to the plane of a lattice piece element formed by the first chord member and the second chord member the construction of the lattice piece element on the other hand is simplified.

According to another optional modification of the invention the fastening means at the at least one second web member is identical to and/or matching with the fastening means at the second chord member.

The connectability of a fastening means to the second web member to form a fastening means at a second chord member of further lattice piece element thereby is ensured, and at the same time the complexity of a connection between these components is reduced.

Preferably, the second web member extends obliquely or vertically to the plane defined by the first chord member and the second chord member and/or the number of the web members is at least as large as the number of the fastening means at the second chord member. In this way, an advantageous shape of a lattice piece element is achieved. It can, however, also be provided that the number of the web members is greater than the number of the fastening means arranged at the web members. A web member oriented at 90° relative to the chord member also is referred to as post, whereas obliquely oriented web members also are referred to as diagonals.

The invention also comprises a lattice piece element for a crane boom, which is used in the lattice piece according to the invention.

The advantage of a lattice piece for a crane boom, which comprises two above-described lattice piece elements, is the variability in its basic construction. It thus is possible to construct a non-broadened as well as a broadened crane boom by means of the two lattice piece elements. In narrow crane use, the lattice piece is assembled from two lattice piece elements. In broad crane use, the lattice piece is assembled with the two lattice piece elements and the additional grating elements. In addition, the lattice piece elements used can be stacked in a space-saving way and therefore can also be used in confined space conditions. In this connection it also is advantageous that the individual lattice piece elements can have road transport dimensions. The lattice piece for example can be disassembled into the lattice piece elements for transport.

It is, however, also possible to transport the non-broadened lattice piece in an assembled condition. The free interior space in the lattice piece then is utilized for transporting other crane components. Here, a particularly good utilization of space is possible during transport.

According to the invention the first lattice piece element and the second lattice piece element are connected with each other such that the fastening means at the second chord member of the first lattice piece element is releasably connected with the fastening means at the web member of the second lattice piece element and the fastening means at the web member of the first lattice piece element is releasably connected with the fastening means at the second chord member of the second lattice piece element.

This results in a lattice piece of a crane boom divisible in its length, which can be stored or transported in a non-assembled condition in a particularly space-saving way.

As an alternative, the first lattice piece element and the second lattice piece element according to the invention are connected with each other such that the fastening means at the web member of the first lattice piece element is releasably connected with the fastening means at the web member of the second lattice piece element. According to a preferred embodiment, in which the second web member is oriented vertically to the plane formed from the associated chord members, the two lattice piece elements connected with each other substantially correspond to a U-shape in their cross-section.

When the two lattice piece elements are connected with each other as described above, it becomes possible to provide a crane boom which is broadened in its cross-section. Due to broadening of the lattice piece in the described way, the torsion moment of inertia, the area moment of inertia around the vertical axis, and the thrust surface in transverse direction rise significantly. It thereby is possible to increase the load capacity of a crane boom wholly or partly constructed of the lattice piece elements according to the invention. As compared to other methods or devices for broadening boom sections, broadening of the lattice piece according to the invention is effected with a minimum of additional material expenditure.

In addition, the assembly of a crane boom wholly or partly constructed of such lattice pieces only involves little assembly effort.

According to another modification of the invention the lattice piece according to the invention furthermore comprises at least one grating element which is releasably attached to a fastening means of the second chord member of the first lattice piece element and to a fastening means of the second chord member of the second lattice piece element, preferably by means of fastening means which correspond to the fastening means of a second web member or are designed to cooperate with a fastening means of the second chord member of a lattice piece element.

When joining two lattice piece elements to form a U-shape, the open side thereby is closed with the grating element, so that a complete lattice piece for a crane boom is created. The grating element performs the function of web members between the second chord members of the various lattice piece elements.

In addition it can be provided at the lattice piece that further strut bars are provided. The same can extend from one fastening means of a second web member to a fastening means of a second chord member. Preferably, however, it also is possible that these struts extend from a first chord member of a lattice piece element to a grating element, in particular to a portion of the grating element arranged centrally in width direction.

It also is advantageous to mount a footplate or walkway grid on one side of a lattice piece, so that the boom is walkable during the assembly operation.

Advantageously, the footplate can releasably be connected with the first lattice piece element as a unit with the guy rods. When used in the broad lattice piece it is detached from the first lattice piece and in particular mounted centrally in the broad lattice piece. It here is advantageous that the guy rods now are again in the desired position of use. The operator can perform bolting of the guy rods from the footplate.

When preparing the crane, the footplate itself can serve as shelf for the hoisting cable.

Alternatively, the footplate also can firmly be attached to the lattice piece element. In this case a further plate, in particular footplate (or walkway grid) would be required, when the lattice piece is constructed broad. This footplate can be mounted centrally in the broad lattice piece. Thus, it can serve as cable shelf when preparing the crane. In this case, however, at least one guy rod must be folded down.

The invention also comprises a crane boom which includes lattice pieces according to any of the above-described variants or a lattice piece element according to any of the above-described variants.

BRIEF DESCRIPTION OF THE DRAWINGS

Further features, details and advantages of the invention will be explained with reference to the Figures discussed below, in which.

DESCRIPTION OF THE PREFERRED EMBODIMENTS

Figure 1:
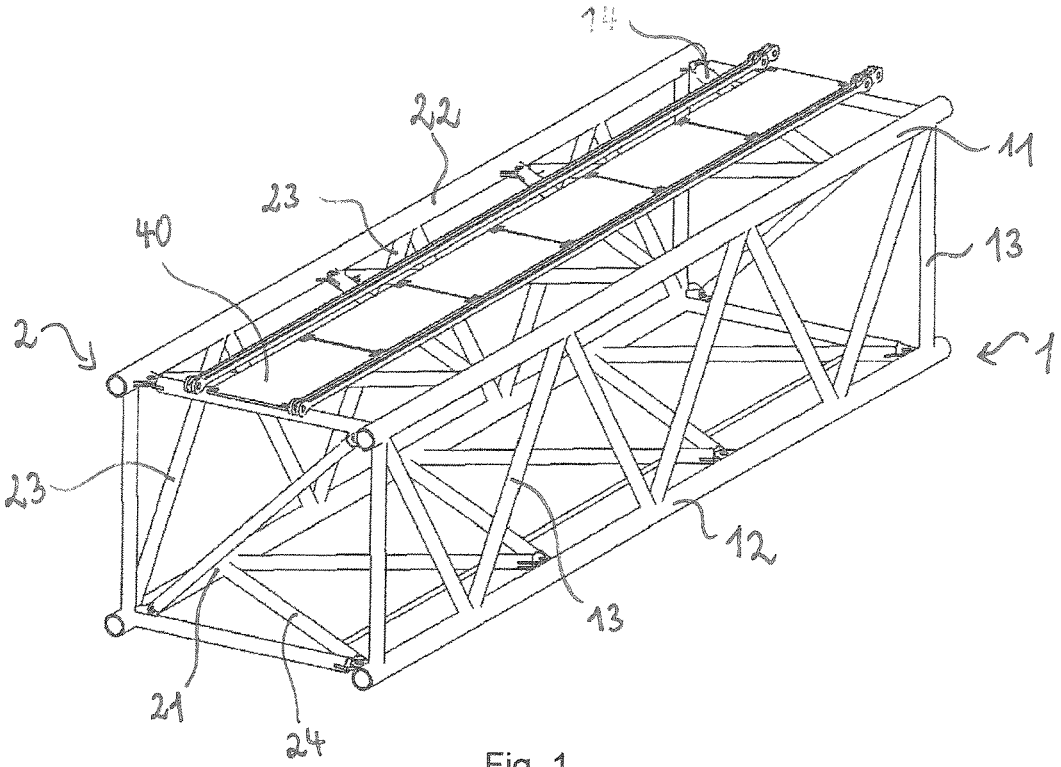
FIG. 1: shows a perspective view of two interconnected lattice piece elements according to the invention with a walkway grid.

FIG. 1 shows a perspective view of two interconnected lattice piece elements 1; 2 according to the invention. Each lattice piece element 1; 2 includes a first chord member 11; 21 and first web members 13; 23 connected with the first chord member 11; 21, which at their end facing away from the first chord member 11; 21 are firmly connected with the second chord member 12; 22. From the plane formed by the first chord member 11; 21 and the second chord member 12; 22 at least one second web member 14; 24 extends vertically, which at its end remote from the first chord member 11; 21 comprises a fastening means 15; 25. This fastening means is releasably connected with a fastening means 16; 26 provided at the second chord member 12; 22. This results in a lattice piece of a crane boom which in its rectangular cross-section has a chord member 11; 12; 21; 22 at each of its corner points of the cross-section. On an outside defined by two chord members there is also mounted a walkway grid 40, so that the boom is walkable during assembly/disassembly. It also is possible to provide receptacles for depositing and arresting guy rods on both sides of the walkway grid.

FIGS. 1 to 6 show a reconstruction variant from a non-broadened state of a lattice piece (FIG. 1) to a broadened lattice piece (FIG. 6) in a chronological sequence. Two variants are conceivable here for the broadening of the section, wherein in the following a first variant is explained, which has an open side pointing upwards to be closed by a grating element.

Initially, all connections at the non-broadened lattice piece 1; 2 are separated, so that the lattice piece element 1 located at the top can be lifted off. The lattice piece element 1 located at the top is characterized by the fact that the second web members 14 are arranged on the side remote from the ground.

Figure 2:
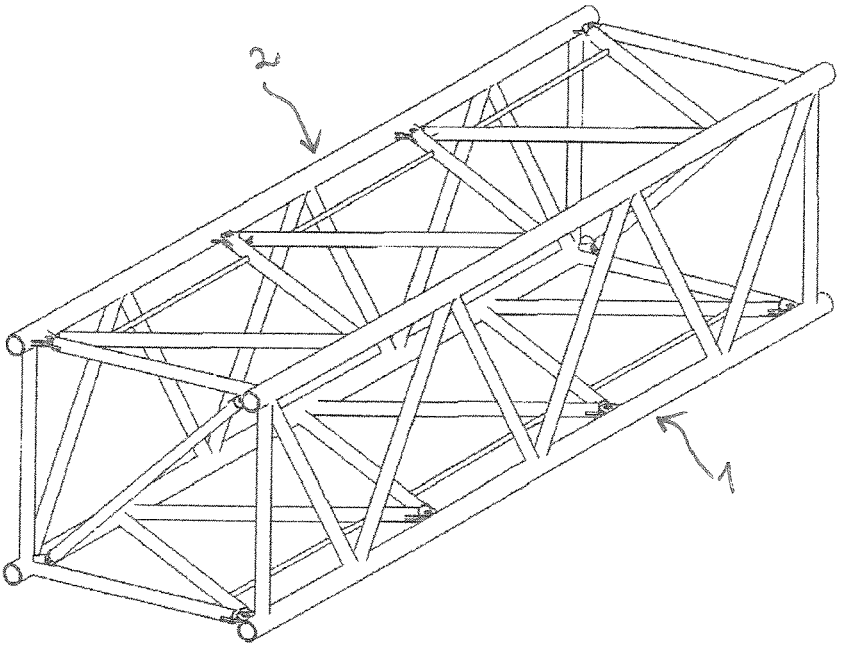
FIG. 2: shows a perspective view of two interconnected lattice piece elements according to the invention.

FIG. 2 shows the non-broadened lattice piece 1; 2, wherein the walkway grid 40 has been removed already.

Figure 3:
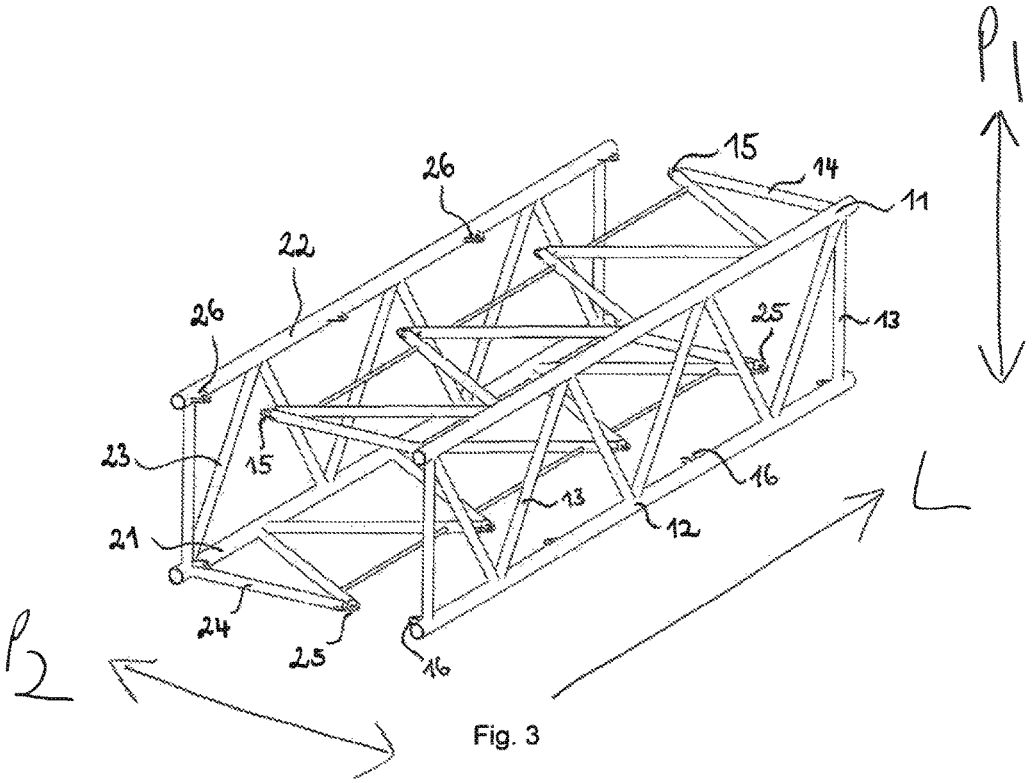
FIG. 3: shows two lattice piece elements according to the invention in a disassembled state.

FIG. 3 shows a disassembled lattice piece in which the two lattice piece elements 1; 2 are detached from each other. The respective fastening means accordingly no longer cooperate with their counterpart.

Subsequently, the lattice piece element 1 is rotated such that it points downwards with its second web members 14. It then is possible to attach the fastening means 15 at the second web member ends 14 to the corresponding fastening means 25 of the second lattice piece element 2 and connect the same with each other. FIG. 3 shows a state of the two lattice piece elements 1; 2 in which the fastening means previously connected with each other are released.

Figure 4:
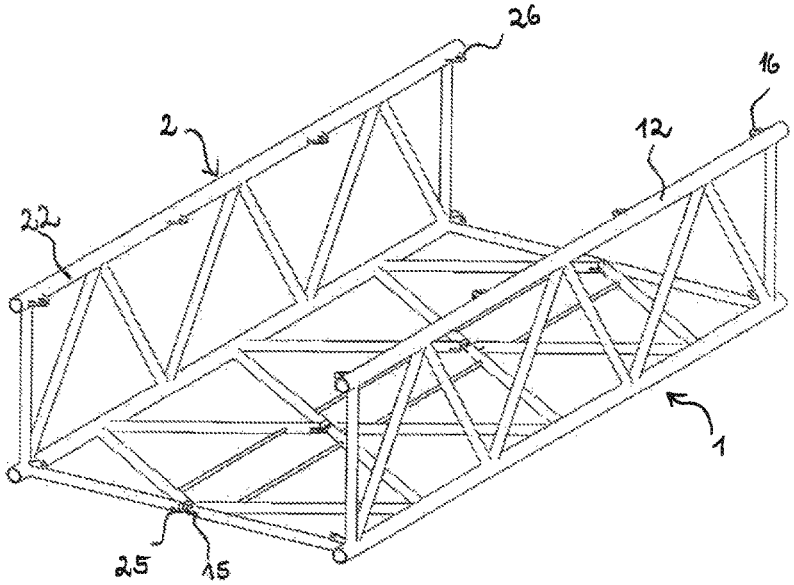
FIG. 4: shows two lattice piece elements according to the invention with interconnected web members.

FIG. 4 then shows the two interconnected lattice piece elements 1; 2, wherein the fastening means 15, 25 at the two second web members 14; 24 are connected with each other. In this way, an approximately U-shaped structure with a side open towards the top is obtained in cross-section. This open side is closed with separate grating elements 30, which on both sides are connected to the free fastening means 16; 26 at the chord members 12; 22. Subsequently, reinforcing struts 50 extending in the cross-sectional plane are attached. The grating element 50 likewise can be assembled from a plurality of individual elements or consist of one single element.

Figure 5:
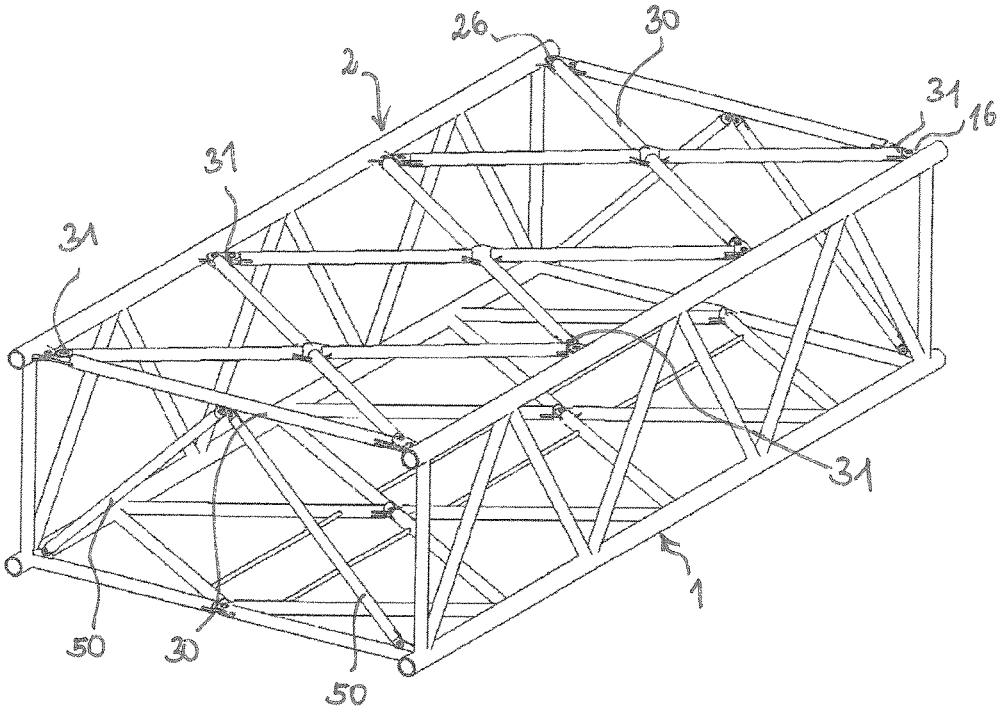
FIG. 5: shows a lattice piece in a broadened configuration with a grating element.

FIG. 5 shows the lattice piece in a state in which the open side of the construction produced by the two lattice piece elements has been closed with a grating element 30. The grating element 30 includes fastening means 31 which can cooperate with the fastening means of the chord members.

Figure 6:
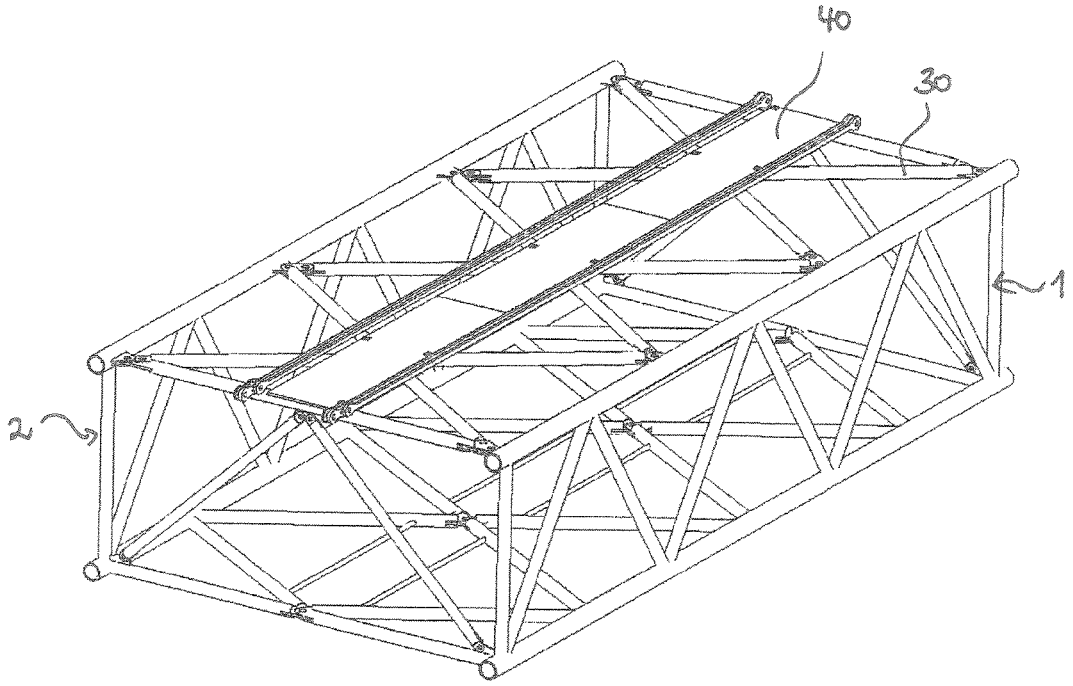
FIG. 6: shows the lattice piece in the broadened configuration with a walkway grid.

FIG. 6 finally shows the broadened lattice part with a walkway 40 extending in longitudinal direction, which ensures walkability of the lattice piece during assembly or also in future operation.

Figure 8:
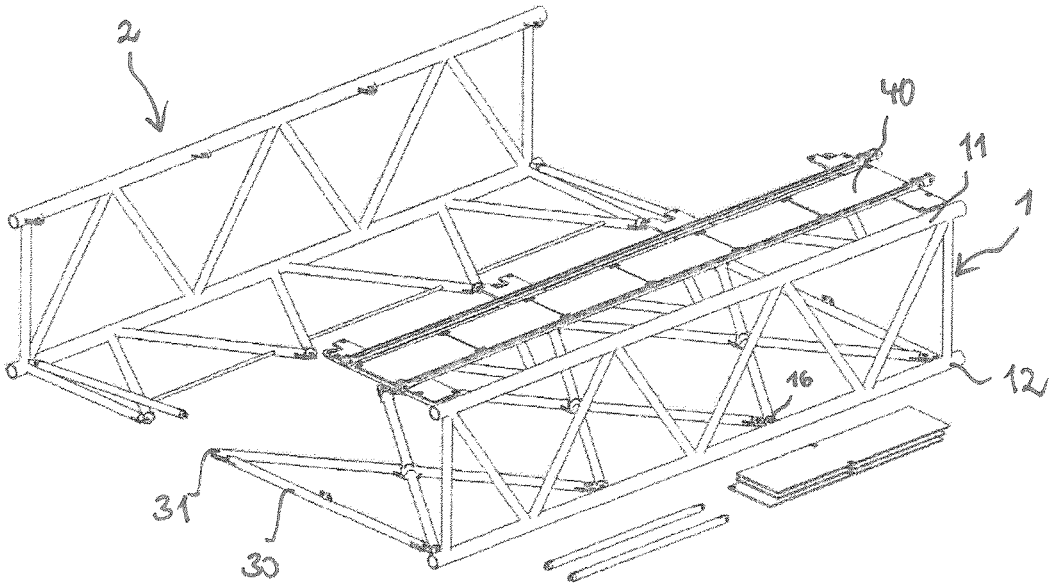
FIG. 8: shows a half-mounted broadened lattice piece.
Figure 9:
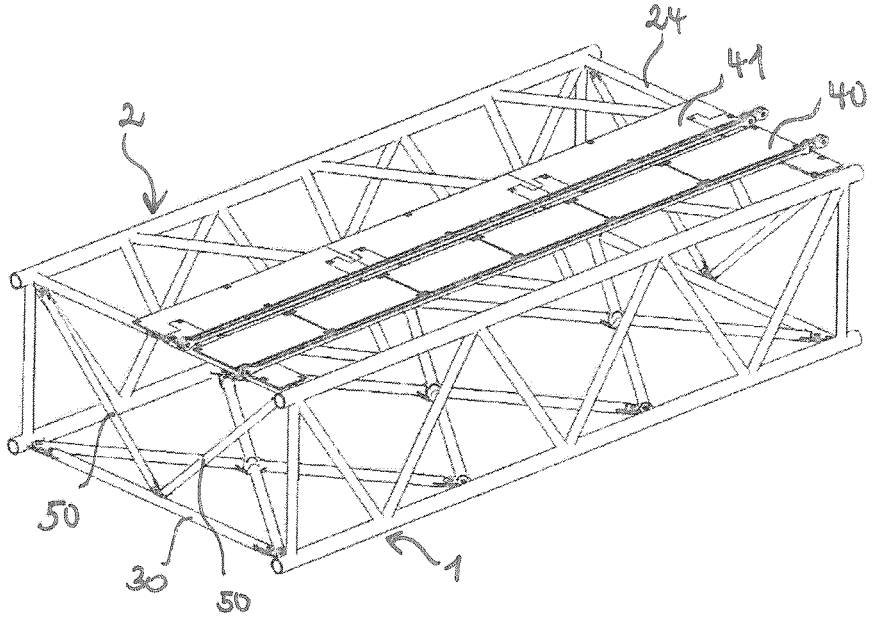
FIG. 9: shows a fully mounted broadened lattice piece with central walking surface.

In a second variant, a reconstruction from non-broadened to broadened is illustrated with reference to FIGS. 7 to 9, in which the open side of the structure formed by the two lattice piece elements 1; 2 faces towards the bottom.

Figure 7:
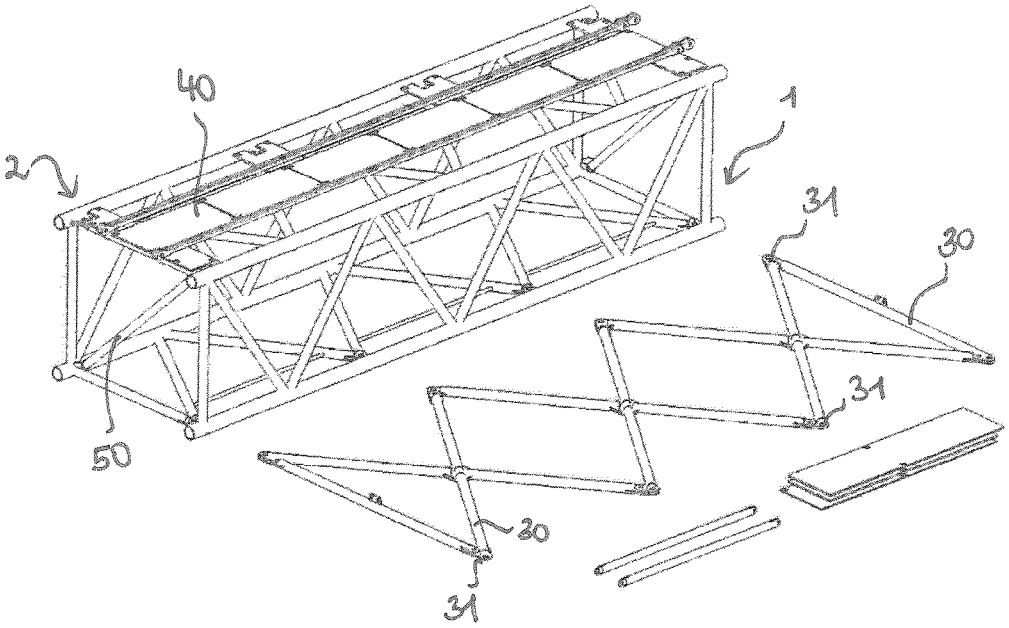
FIG. 7: shows a lattice piece comprising two lattice piece elements according to the invention in a non-broadened configuration.

FIG. 7 shows the provision of grating elements 30 on the ground or on a separate assembly substructure. On the same, the grating elements 30 are aligned and connected with each other. In addition, all connections at the non-broadened lattice piece are separated and the lattice piece element 1 located at the top is lifted off and connected with the fastening means 16 of the second chord members 12 at the fastening means 31 of the prepared grating elements 30. The attached lattice piece 1 then can be supported on the grating element 30 by means of reinforcing struts 50 (cf. FIG. 9, reference numeral 50). The second lattice piece element 2 subsequently is rotated such that it is pointing upwards with the previous underside, i.e. its second web members 24 now are facing away from the side close to the ground. With the fastening means 25 of the second web members 24 the second lattice piece element 2 is attached to the second web members 14 of the first lattice piece 1 and connected with the same. At the same time the fastening means 26 of the second chord member 22 are connected with the fastening means 31 of the grating elements 30. In addition, the spatial diagonal of the second lattice piece element 2 (reinforcing strut 50) is attached.

For the fastening means 15; 16; 25; 26; 31 releasable connecting means are conceivable. Preferably, the same are designed as bolt connection.

FIGS. 10 to 15 show various designs of the bolt connections.

There are two different possibilities of arranging the bolts. On the one hand, a bolt can be provided in longitudinal direction of the lattice piece element or the bolt can be arranged perpendicularly to the longitudinal direction vertical to a bottom plane.

In an arrangement of the bolts in longitudinal direction, the assembly of the lattice piece element or the reconstruction from a non-broadened to a broadened configuration is greatly simplified, as the lattice piece elements and the additional outcrossing elements (grating elements 30) can be inserted into each other more easily.

Figure 10:
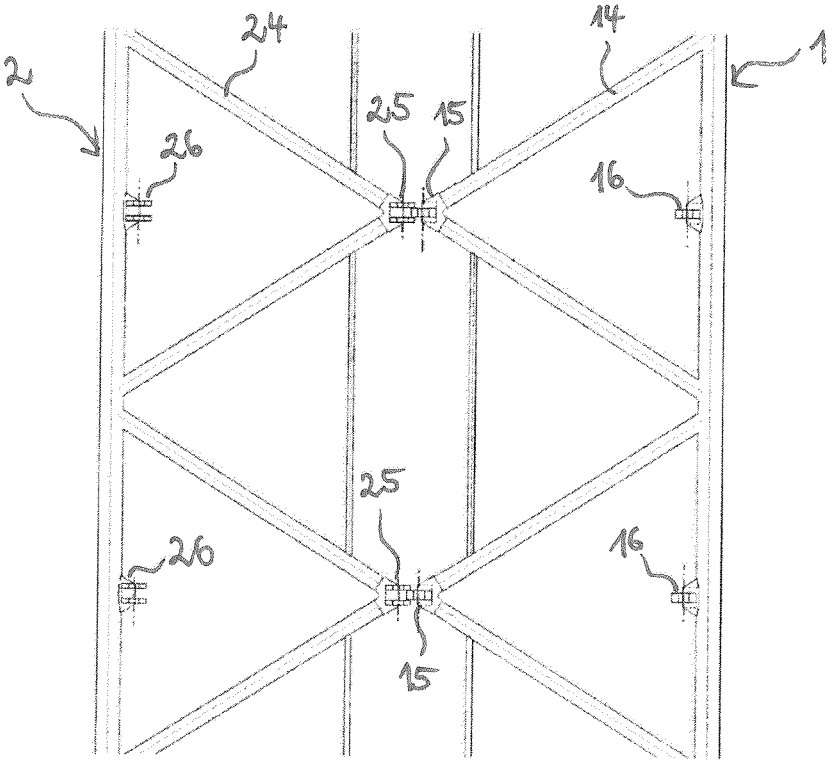
FIG. 10-FIG. 15: show various embodiments of the fastening means at the second web member and/or the second chord member.

FIG. 10 shows an arrangement pattern in which the fastening means can be a positive or a negative terminal. This is the case, for example, in a fork-finger connection. Matching fastening means then each have a positive and a negative section half. In the illustrated Figure, the fastening means 25 for example is a fork in which the fastening means 15 can engage with its finger. By means of a bolt insertable in longitudinal direction the connection of the two fastening means thus can be made.

The fastening means 26 at the second lattice piece element 2 is a fork, whereas the fastening means 16 at the first lattice piece 1 is a finger.

Figure 11:
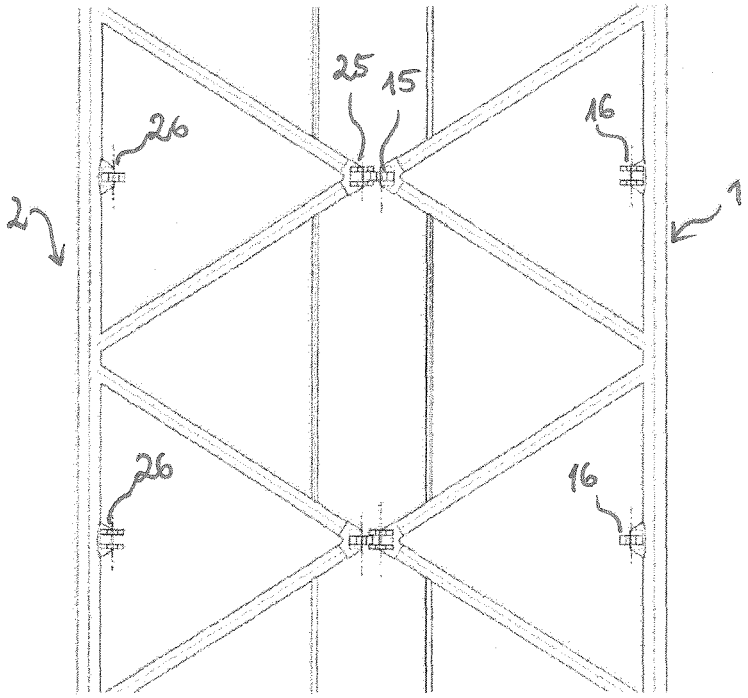

FIG. 11 shows an alternative arrangement of the fastening means. Again, all fastening means consist of a fork or a finger, wherein the fork constitutes a negative section and a finger constitutes a positive section. In contrast to FIG. 10 the fastening means of the second web member or the second chord member are not identical, but alternate along the longitudinal direction of the lattice piece 1; 2.

Figure 12:
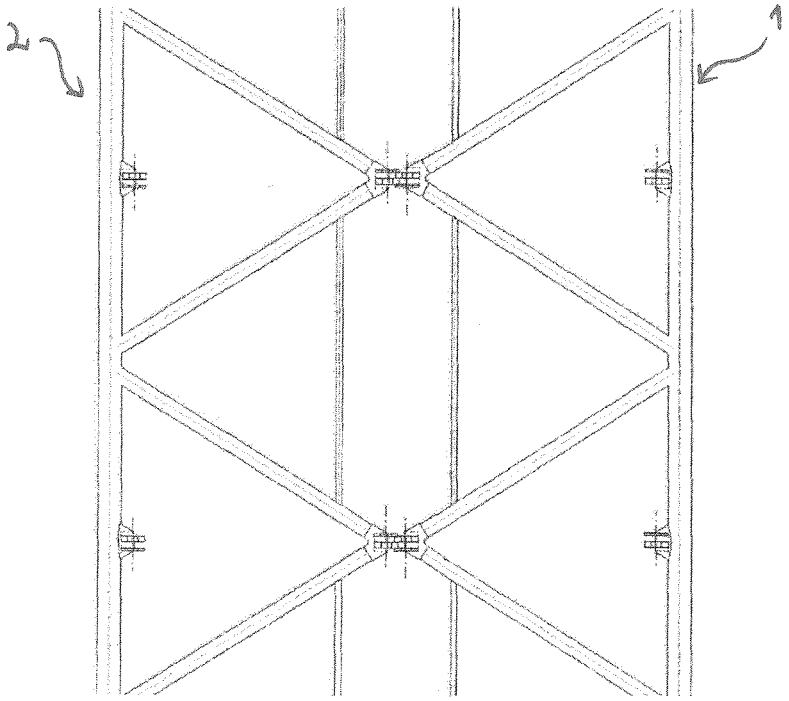

FIG. 12 shows the fastening means in the form of asymmetrical connections, as they occur in a fork-fork-connection. There are obtained two identical lattice piece elements with regular arrangement.

Figure 13:
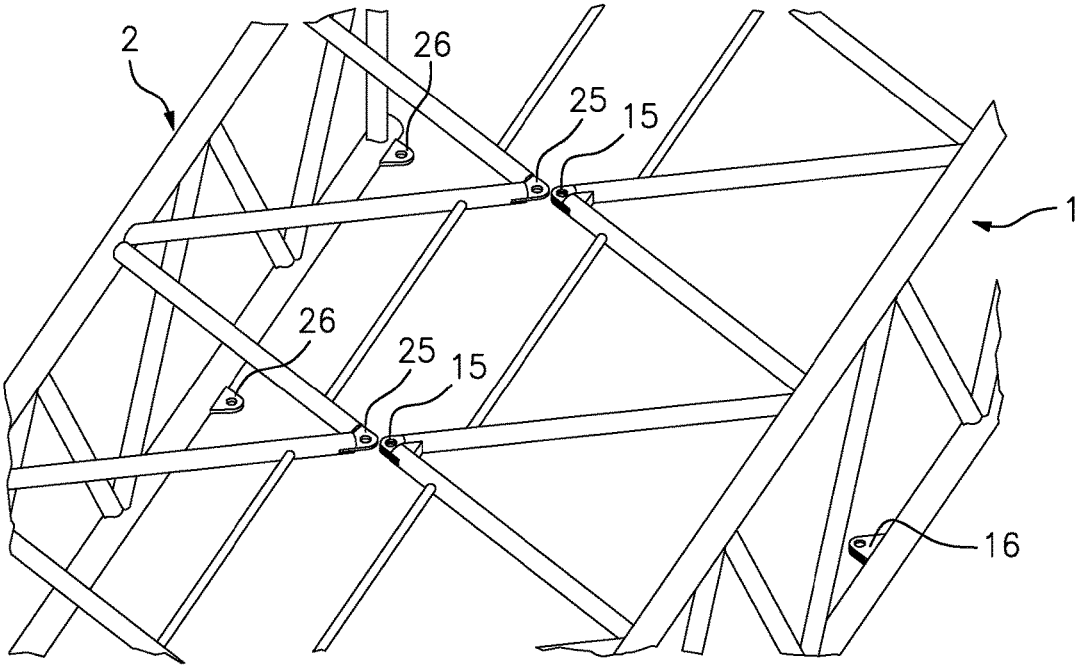
Figure 14:
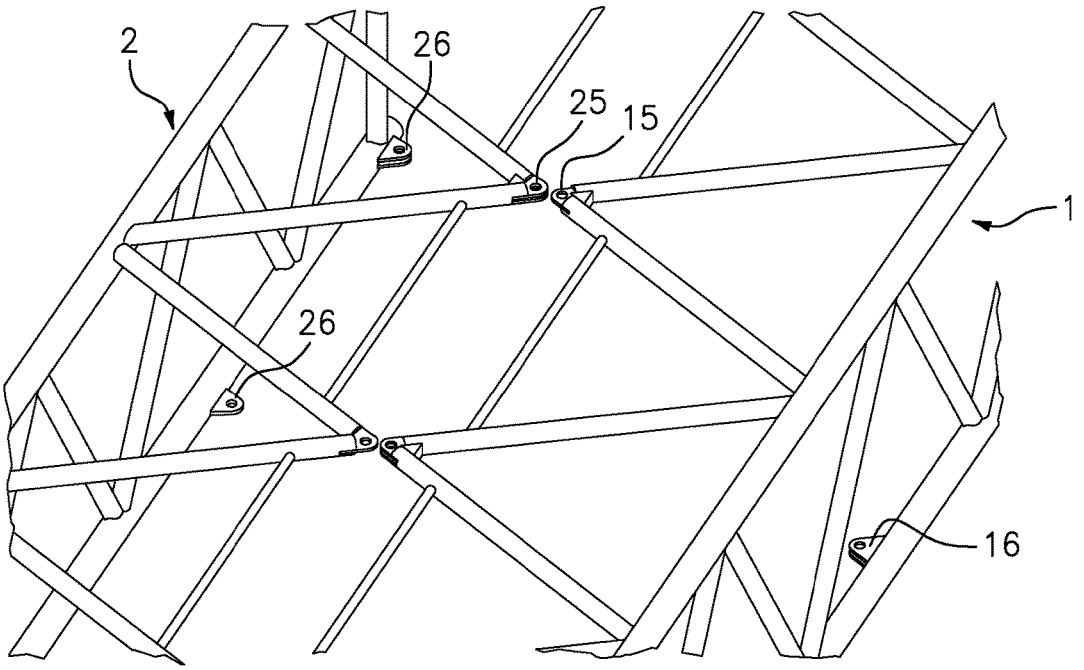
Figure 15:
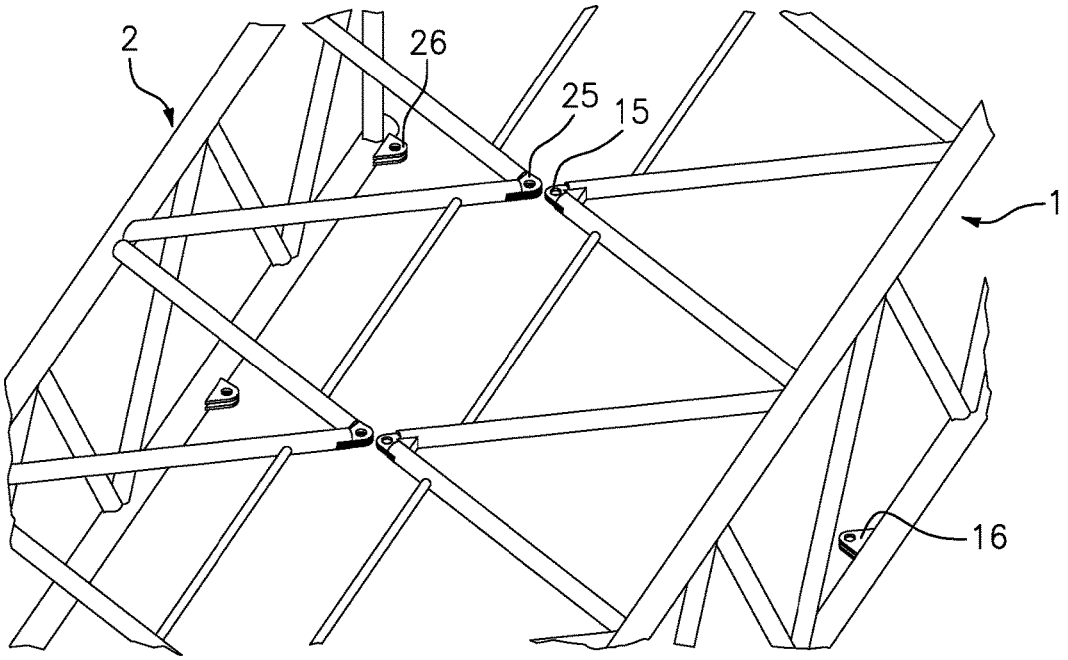

FIGS. 13 to 15 show fastening means which can be attached to each other by means of bolts to be introduced vertically. The advantage here is that the construction is simplified.

FIG. 13 again shows the arrangement of fastening means with positive and negative terminals, as it is typical for a fork-finger connection. One of two fastening means to be connected with each other has a positive section half and the other one has a negative section half.

FIG. 14 again shows a fork-finger connection which can be achieved with the fastening means, but were two identical section halves are arranged alternately in longitudinal direction.

FIG. 15 shows fastening means which include terminals asymmetrical to each other, such as a fork-fork connection, wherein two identical lattice piece elements with mutually rotated arrangements are possible.

Figure 16:
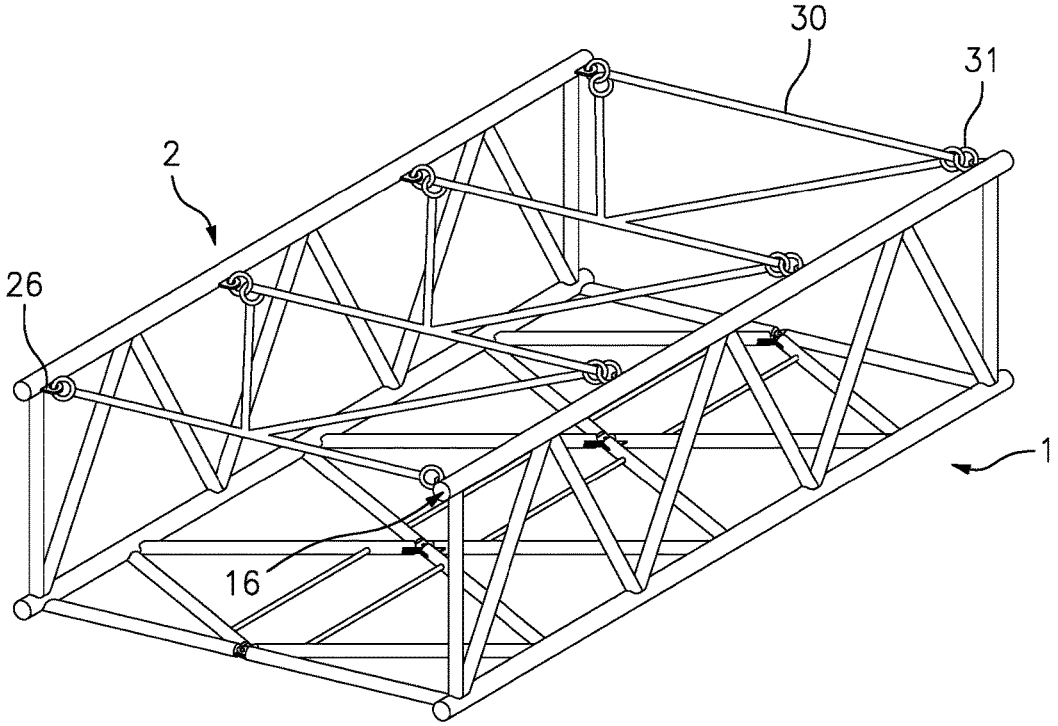
FIG. 16: shows a broadened lattice piece whose grating element includes a K-bond.

FIG. 16 shows a perspective view of a broadened lattice part, in which the grating element 30 or the plurality of grating elements 30 for closing the side of the lattice part open towards the top corresponds to the pattern of a K-bond. A K-bond consists of several K-shaped elements which are joined and then together form the end of the open side. When broadening the section, the open side of the U-shaped lattice structure (depending on whether the open side lies at the top or at the bottom) is closed with one or more additional grating elements 30. The grating elements 30 therefor are connected to the free fastening means 16; 26 of the two lattice piece elements 1; 2. The additional grating 30 can be designed demountable in one part or in several parts. Advantageously, the individual elements have dimensions which provide for road transport without any problems. It also is advantageous when the individual elements of the grating 30 can be stacked.

For the grating 30 virtually all commonly used patterns can be used, such as e.g. a K-bond as shown in FIG. 16 or an outcrossed or rhombic pattern.

Figure 17:
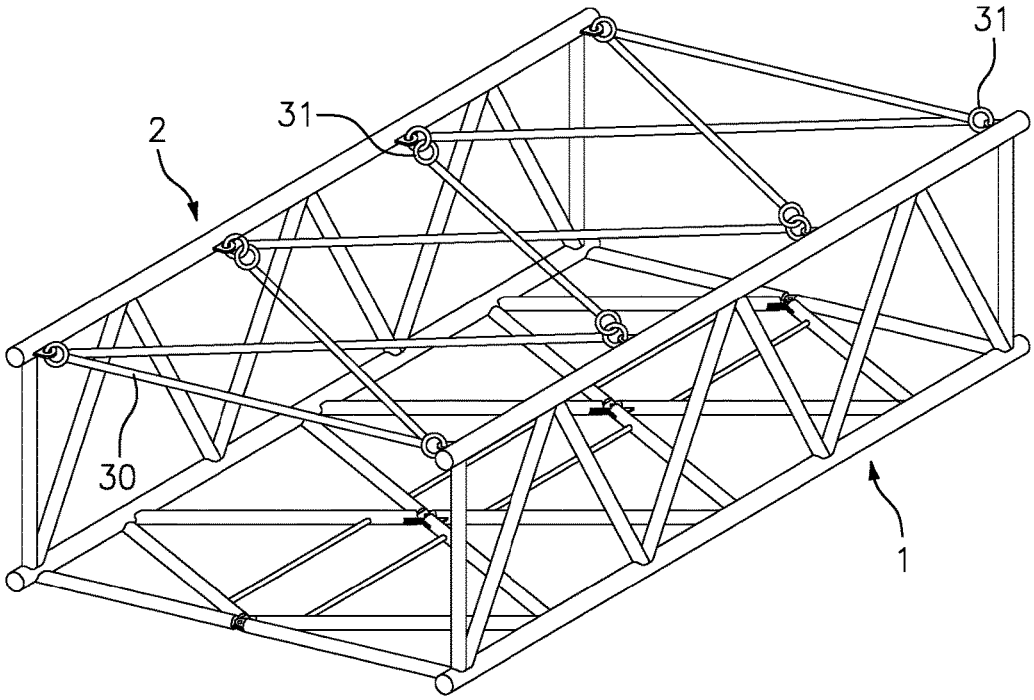
FIG. 17: shows a broadened lattice piece whose grating element has a rhombic pattern.

FIG. 17 shows a grating element 30 which has a pattern of an outcrossing. The first and the last cross here has a post 32 (both are identical), the other one or more identical inner crosses have no post 32.

The invention claimed is:

1. A lattice piece for a crane boom with a first and a second lattice piece element (1; 2), each comprising:

a first chord member (11; 21) which extends substantially parallel to the longitudinal direction of the lattice piece element (1; 2), a second chord member (12; 22) which extends substantially parallel to the longitudinal direction of the lattice piece element (1; 2), a first web member (13; 23) which is fixed to the first chord member (11; 21) at a first end and fixed to the second chord member (12; 22) at a second end and extends in a plane defined by the first chord member (11; 21) and the second chord member (12; 22), and a second web member (14; 24) which is fixed to the first chord member (11; 21) at a first end and extends in a plane from the first chord member (11; 21) which is substantially perpendicular to the plane defined by the first and second chord members (11, 21:12, 22), such that each said lattice piece element (1; 2) is substantially L-shaped when viewed in the longitudinal direction of the lattice piece element (1; 2), wherein at an end facing away from the first chord member (11; 21), the second web member (14; 24) has first fastening means (15; 25) for a releasable connection, second fastening meat (16; 26) are located on the second chord member (12, 22);

in a first state, the first lattice piece element (1) and the second lattice piece element (2) are connected with each other such that second fastening means (16) at the second chord member (12) of the first lattice piece element (1) is releasably connected with the first fastening means (25) at the second web member (24) of the second lattice piece element (2) and the first fastening means (15) at the second web member (14) of the first lattice piece element (1) is releasably connected with the second fastening means (26) at the second chord member (22) of the second lattice piece element (2), such that the two Interconnected lattice piece elements (1;2) substantially correspond to a rectangular shape in their cross-section, and in a second state the first lattice piece element (1) and the second lattice piece element (2) are connected with each other such that the first fastening means (15) at the second web member (14) of the first lattice piece element (1) is releasably connected with the first fastening means (25) at the second web member (24) of the second lattice piece element (2) in a perpendicular orientation of the second web members (14; 24) to the plane defined by the first and second chord members (11; 12; 21; 22), such that the two interconnected lattice piece elements (1; 2) substantially correspond to a U-shape in their cross-section.

2. The lattice piece (20) according to claim 1, comprising:

at least one grating element (30) which is releasably attached to the second fastening means (16) of the second chord member (12) of the first lattice piece element (1) and to the second fastening means (26) of the second chord member (22) of the second lattice piece element (2), by fastening means (31) which correspond to the first fastening means (15; 25) of the second web member (14; 24).

3. The lattice piece according to claim 2, wherein the grating element is configured to releasably fix a footplate (40) centrally in a width direction thereof.

4. The lattice piece according to claim 2, additionally comprising reinforcing struts (50) arranged to support the lattice piece elements (1; 2) on the at least one grating element (30).

5. The lattice piece according to claim 2, wherein the at least one grating element (30) has the shape of a K in the plane which is substantially perpendicular to the plane defined by the first and second chord members (11, 21;12, 22).

6. The lattice piece) according to claim 2, wherein the at least one grating element (30) has the shape of an outcrossing in a plane which is substantially perpendicular to the plane defined by the first and second chord members (11, 21;12, 22).

7. The lattice piece element (1; 2) for a lattice piece according to claim 1, wherein the second chord member (12; 22) includes several second fastening means (16; 26) which are distributed along the longitudinal direction of the second chord member (12; 22).

8. The lattice piece element (1; 2) according to claim 7, wherein the first fastening means (15; 25) arranged at the second web member (14; 24) are configured to cooperate with the second fastening means (16; 26) arranged on the second chord member (12; 22).

9. The lattice piece element (1; 2) according to claim 7, wherein arrangement positions of the second fastening means (16; 26) of the second chord member (12; 22) and the first fastening means (15; 25) of the second web member (14; 24) are identical based on the longitudinal direction of the lattice piece element (1; 2).

10. The lattice piece element (1; 2) according to claim 7 4, wherein the several second fastening means (16; 26) of the second chord member (12; 22) are arranged equidistantly to each other in the longitudinal direction of the second chord member (12; 22).

11. The lattice piece element (1; 2) according to claim 7, wherein the first fastening means (15; 25) at the second web member (14; 24) is identical to or matching with the second fastening means (16; 26) at the second chord member (12; 22).

12. The lattice piece element (1; 2) according to claim 7, furthermore comprising a footplate (40) which is firmly attached to the lattice piece element.

13. The lattice piece element (1; 2) according to claim 1, wherein the fastening means (15; 16; 25; 26) at the second chord member (12; 22) or the second web member (14; 24) forms a bolt connection, and is either a fork or a finger of a fork-finger connection, or a fork of an asymmetrical fork-fork connection.

14. The lattice piece element (1; 2) according to claim 13, wherein the fastening means (15; 16; 25; 26) at the second chord member or the second web member accommodates a bolt in the longitudinal direction of the lattice piece element (1; 2) or a direction extending transversely to the longitudinal direction of the lattice piece element (1; 2) and parallel to the plane formed by the first chord member (11; 21) and the second chord member (12; 22).

15. The lattice piece element (1;2) according to claim 13, wherein the first fastening means (15; 25) comprise fork-finger connections identically arranged along the longitudinal direction of the lattice piece elements (1;2) or alternatingly arranged along the longitudinal direction of the lattice piece elements (1;2).

16. The lattice piece element (1; 2) according to claim 1, wherein the second web member (14; 24) extends obliquely or vertically from the first chord member (11; 21) and the number of first and second web members is at least as large as the number of the second fastening means (16; 26) at the second chord member (12; 22).

17. The lattice piece element (1; 2) according to claim 1, comprising a footplate (40) which is releasably mountable in the longitudinal direction on an outside of the first lattice piece element.

18. The lattice element (1; 2) according to claim 17, wherein the footplate (40) is releasably mountable as unit with guy rods.

19. A crane boom comprising the lattice piece according to claim 1.

20. A method for transporting a lattice piece according to claim 1, wherein the lattice piece is transported in a non-broadened condition and an interior space defined by the lattice piece is utilized for transporting other crane components.

21. The lattice piece element (1; 2) according to claim 1, wherein the first web member (13; 23) is fixed to the first chord member (11; 21) and the second chord member (12; 22), and the second web member (14; 24) is fixed to the first chord member (11; 21) and extends in the plane from the first chord member (11; 21) which is substantially perpendicular to the plane defined by the first and second chord members (11, 21;12, 22).

* * * * *